US006146820A

United States Patent [19]

Merkel et al.

[11] Patent Number: 6,146,820

[45] **Date of Patent: *Nov. 14, 2000**

[54] PHOTOGRAPHIC ELEMENT CONTAINING A DIR COUPLER

[75] Inventors: Paul B. Merkel, Victor, N.Y.; Philip A. Allway, Rickmansworth, United Kingdom; David A. Steele, Webster; Jerrold N. Poslusny, Rochester, both of N.Y.

[73] Assignee: Eastman Kodak Company, Rochester, N.Y.

[ * ] Notice: This patent is subject to a terminal disclaimer.

[21] Appl. No.: 09/210,291

[22] Filed: Dec. 11, 1998

Related U.S. Application Data

[63] Continuation-in-part of application No. 08/824,223, Mar. 25, 1997.

[51] Int. Cl.[7] ..... G03C 1/08

[52] U.S. Cl. ..... 430/544; 430/955; 430/957; 430/505; 430/553; 430/555; 430/557; 430/558

[58] Field of Search ..... 430/544, 955, 430/957, 543, 553, 555, 557, 558, 505

[56] References Cited

U.S. PATENT DOCUMENTS

| | | | |
|---|---|---|---|
| Re. 29,379 | 8/1977 | Shiba et al. | 430/544 |
| 3,933,500 | 1/1976 | Shiba et al. | 430/544 |

FOREIGN PATENT DOCUMENTS

04/278942 10/1992 Japan .

*Primary Examiner*—Geraldine Letscher
*Attorney, Agent, or Firm*—Edith A. Rice

[57] ABSTRACT

This invention comprises a photographic element having a support bearing at least one silver halide emulsion and at least one DIR coupler of structure I:

I wherein:

Z is a moiety which can react with oxidized developer to release a coupling-off group;

$R_1$ is selected from the substituents shown in formulas II, III, IV and V:

II —$SCH_2CO_2R_2$, III —$NHCOR_3$, IV —$OCH_2CO_2R_4$, V —$OR_5$;

$R_2$ is an alkyl group with at least 3 carbon atoms or an aryl group with at least 7 carbon atoms;

$R_3$ is an alkyl or alkoxy group with at least 4 carbon atoms or an aryl or phenoxy group with at least 7 carbon atoms; and $R_4$ and $R_5$ are alkyl groups with at least 4 carbon atoms or aryl groups.

20 Claims, No Drawings

PHOTOGRAPHIC ELEMENT CONTAINING A DIR COUPLER

CROSS REFERENCE TO RELATED APPLICATIONS

This application is a continuation in part of U.S. patent application Ser. No. 08/824,223 filed Mar. 25, 1997, allowed, the entire disclosure of which is incorporated herein by reference.

FIELD OF THE INVENTION

This invention relates to a photographic element containing a purine-releasing DIP, coupler.

BACKGROUND OF THE INVENTION

Many silver halide photographic elements, in particular color negative films, contain so-called DIR (development inhibitor releasing) couplers. In addition to forming imaging dye, DIR couplers release inhibitors that can restrain silver development in the layer in which release occurs as well as in other layers of a multilayer photographic material. DIR couplers can help control gamma (contrast), enhance sharpness (acutance), reduce granularity and provide color correction via interlayer interimage effects. U.S. Pat. Nos. 3,933,500 and Re. 29,379 broadly disclose DIR couplers with azole-type coupling off groups. Japanese Patent Application JP04/278942 discloses couplers that release purine coupling-off groups.

PROBLEM TO BE SOLVED BY THE INVENTION

There has been a need for more effective DIR couplers. DIR couplers that release inhibitors that efficiently reduce silver development are desired. DIR couplers that are effective with silver chloride emulsions are also needed. In addition it is desirable that such couplers have good reactivity to maximize rates and efficiencies of inhibitor release and minimize the amount of DIR coupler in the photographic element. It is also desirable that the DIR couplers be stable toward long term storage or toward storage at elevated temperatures. DIR couplers that show acceptably low continued coupling when films containing them are placed in a bleach solution immediately after development (i.e. with no intervening stop bath) are also needed. The DIR couplers of this invention possess all of these desirable properties. They are also easily synthesized.

SUMMARY OF THE INVENTION

This invention relates to photographic elements, such as color negative films that contain purine-releasing DIR couplers with suitable substituents to provide efficient inhibition of silver development.

Most generally, this invention comprises a photographic element comprising a support bearing at least one silver halide emulsion and at least one DIR coupler of structure I below:

I

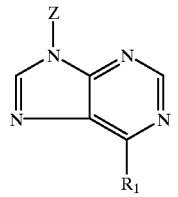

wherein:

Z is a moiety which can react with oxidized developer to release a coupling-off group;

$R_1$ is selected from tie substituents shown in formulas II, III, IV and V:

II —$SCH_2CO_2R_2$, III —$NHCOR_3$, IV —$OCH_2CO_2R_4$, V —$OR_5$;

$R_2$ is an alkyl group with at least 3 carbon atoms or an aryl group with at least 7 carbon atoms;

$R_3$ is an alkyl or alkoxy group with at least 4 carbon atoms or an aryl or phenoxy group with at 1 east 7 carbon atoms; and $R_4$ and $R_5$ are alkyl groups with at least 4 carbon atoms or aryl groups.

ADVANTAGEOUS EFFECT OF THE INVENTION

The DIR couplers of the invention efficiently reduce silver development, including development of silver chloride emulsions, and are readily synthesized.

DETAILED DESCRIPTION OF THE INVENTION

As noted above, the photographic element of this invention comprises a support bearing at least one silver halide emulsion and at least one DIR coupler of Structure I. In structure I, Z is a moiety which can react with oxidized developer to release the coupling-off group comprising the purine inhibitor. In preferred embodiments of the invention, Z is selected from beta-dicarbonyl compounds, such as acylacetanilides, beta-ketoketones and beta-ketoesters, and from indanones, 1-phenyl-3-anilino-5-pyrazolones, pyrazoloazoles, phenols, and naphthols. As noted above, $R_2$ is an alkyl group with at least 3 carbon atoms or an aryl group with at least 7 carbon atoms. Preferably, $R_2$ is an alkyl group having 3 to 9 carbon atoms or a phenyl group with 7 to 12 carbon atoms. As also noted above $R_3$ is an alkyl or alkoxy group with at least 4 carbon atoms or an aryl or phenoxy group with at least 7 carbon atoms. Preferably, $R_3$ is an alkyl or alkoxy group with 6 to 11 carbon atoms or a phenyl or phenoxy group with 9 to 14 carbon atoms. As further noted above, $R_4$ and $R_5$ are alkyl groups with at least 4 carbon atoms or aryl groups. Preferably, $R_4$ and $R_5$ are alkyl groups with 4 to 10 carbon atoms or phenyl groups with 7 to 13 carbon atoms. The number of carbon atoms in $R_2$, $R_3$ , $R_4$ or $R_5$ is chosen so that the inhibitor has sufficient hydrophobicity for efficient adsorption to silver and/or silver halide to ensure effective inhibition of silver development.

In one useful embodiment of this invention, the DIR coupler of structure I is coated in the same layer with at least one tabular grain (T-grain) emulsion, as described below. In another useful embodiment, the DIR coupler of structure I is coated in the same layer with at least one silver chloride emulsion, in which the chloride constitutes at least 75 mole percent of the total halide In a preferred embodiment of the invention, the DIR coupler of structure I is of structure VI, below:

VI

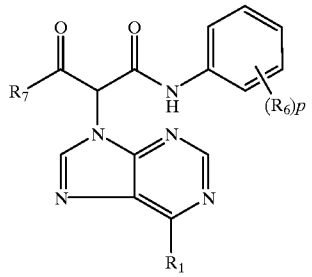

wherein:

$R_1$ is as defined above;

each of the $R_6$ substituents is individually selected from the group consisting of halogen atoms and alkyl, aryl, alkoxy, phenoxy, alkylthio, carbonamido, alkoxycarbonyl, aryloxycarbonyl, acyloxy, sulfamoyl, carbamoyl, alkylsulfonyl, arylsulfonyl, sulfonamido, sulfonyloxy, sulfoxyl and cyano groups;

$R_7$ is a substituent selected from the group consisting of tertiary alkyl, cyclic tertiary alkyl, aryl, heterocycle, arylamino and alkylamino groups; and p is 0 to 4.

In yet another preferred embodiment of the invention, the DIR coupler of structure VI is of structure VII:

VII

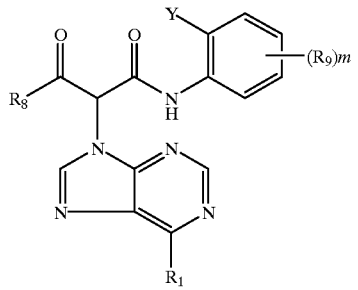

wherein:

$R_1$ is as defined above;

$R_8$ is a tertiary alkyl group;

Y is a halogen atom or an alkyl or alkoxy group;

each $R_9$ substituent is in the 4- or 5-position relative to the anilino nitrogen atom and is a halogen atom or a substituent selected from the group consisting of alkyl, aryl, carbonamido, alkoxycarbonyl, aryloxycarbonyl, sulfonamido, sulfamoyl, acyloxy, alkylsulfonyl, arylsulfonyl, sulfoxyl, sulfonyloxy and cyano groups; and m is 0, 1 or 2.

In yet another particularly useful embodiment of this invention, the DIR coupler of structure I is of formula VIII:

VIII

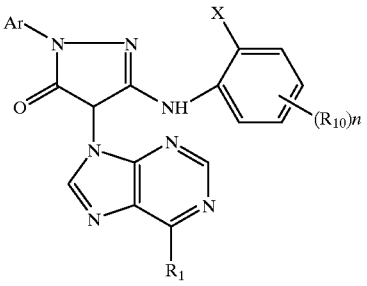

wherein:

$R_1$ is as defined above;

Ar is an unsubstituted aryl group or an aryl group with one or more substituents individually selected from the group consisting of halogen atoms and alkyl, aryl, alkoxy, phenoxy, carbonamido, carbamoyl, sulfonamido, sulfamoyl, alkoxycarbonyl, aryloxycarbonyl, acyloxy, alkylsulfonl, arylsulfonyl, sulfonyloxy, sulfoxyl, alkylthio and cyano groups;

X is a halogen atom or an alkyl or alkoxy group;

n is 0, 1 or 2; and each $R_{10}$ is in the para position or either meta position relative to the NH group and is individually selected from the group consisting of halogen atoms, and alkyl, aryl, alkoxy, phenoxy, carbonamido, carbamoyl, sulfonamido, sulfamoyl, alkoxycarbonyl, aryloxycarbonyl, acyloxy, alkylsulfonyl, arylsulfonyl, sulfonloxy, sulfoxyl, alkylthio, cyano and imido groups.

In a preferred embodiment Ar is an aryl group with at least one position ortho to the point of attachment to the pyrazolone ring unsubstituted, i.e. an aryl group with at least one ortho hydrogen.

The alkyl substituents comprising $R_2$–$R_{10}$, X and Y and on Ar may be branched, unbranched or cyclic and may be substituted or unsubstituted. The alkoxy groups comprising $R_3$, $R_6$, $R_{10}$, X and Y and on Ar, the alkylthio groups comprising $R_6$ and $R_{10}$, and the alkylamino groups comprising $R_7$ may be branched or unbranched and may be substituted or unsubstituted. The aryl groups comprising $R_2$–$R_7$, $R_9$, $R_{10}$ and on Ar, the phenoxy groups comprising $R_3$, $R_6$, $R_{10}$ and on Ar, and the arylamino groups comprising $R_7$ may be substituted or unsubstituted. The heterocycles comprising $R_7$ may be pyrrole, indole, pyridine, thiophene, furan, quinoline, benzofuran, benzothiophene, pyrimidine, pyridazine, imidazole, benzimidazole, indazole and pyrazole. The carbonamido, carbamoyl, alkoxycarbonyl, aryloxycarbonyl, sulfonamido, sulfamoyl, acyloxy, alkylsulfonyl, arylsulfonyl, sulfoxyl and sulfonyloxy groups comprising $R_6$, $R_9$, $R_{10}$ and on Ar may be substituted or unsubstituted. Any substituent may be chosen to further substitute the $R_1$–$R_{11}$, X, Y or Ar groups of this invention that does not adversely affect the performance of the DIR couplers of this invention. Suitable substituents include halogen atoms, such as chlorine, alkenyl groups, alkynyl groups, aryl groups, hydroxy groups, alkoxy groups, aryloxy groups, acyl groups, acyloxy groups, alkoxycarbonyl groups, aryloxycarbonyl groups, carbonamido groups (including alkyl-, aryl-, alkoxy, aryloxy- and alkylamino-carbonamido groups), carbamoyl groups, carbamoyloxy groups, sulfonamido groups, sulfamoyl groups, alkylthio groups, arylthio groups, sulfoxyl groups, sulfonyl groups, sulfonyloxy groups, alkoxysulfonyl groups, aryloxysulfonyl groups, trifluoromethyl groups, cyano groups, imido groups, phosphine groups, phosphonate groups, phosphite groups, phosphate groups and heterocyclic groups, such as 2-furyl, 3-furyl, 2-thienyl, 1-pyrrolyl, 2-pyrrolyl, 1-imidazolyl and N-succinimidyl groups. The aryl groups comprising $R_2$–$R_7$, $R_9$ and $R_{10}$ and on Ar, the phenoxy groups comprising $R_3$, $R_6$, $R_{10}$ and on Ar and the arylamino groups comprising $R_7$ may also be substituted with alkyl groups.

In one particularly useful embodiment $R_1$ is a hydrolyzable $SCH_2CO_2R_2$ group, where $R_2$ is an alkyl group with 3 to 8 carbon atoms. In another particularly useful embodiment one or more DIR couplers of Structure VI or VII is coated in the same layer with at least one blue-sensitive silver halide emulsion. In another useful embodiment, one or more DIR couplers of structure VIII is coated in the same layer with at least one green-sensitive emulsion.

Examples of the DIR couplers of this invention include, but are not limited to, structures A1 to A26, below:

A1

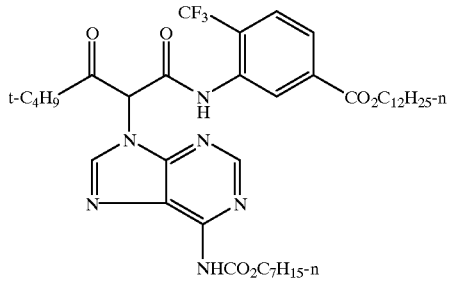

A2

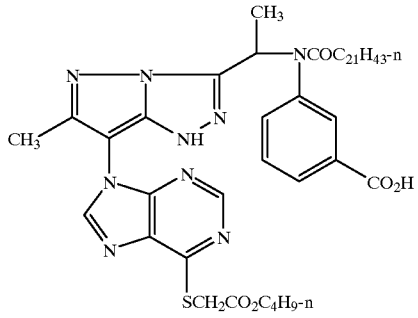

A3

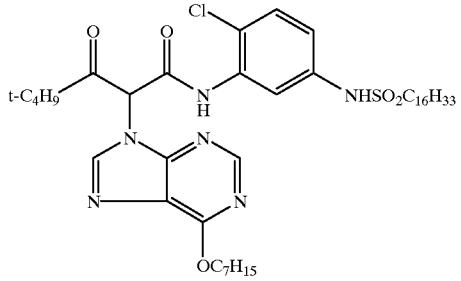

A4

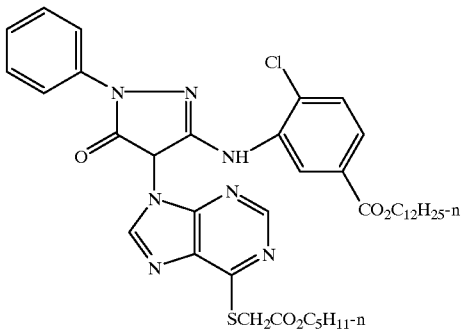

-continued
A5
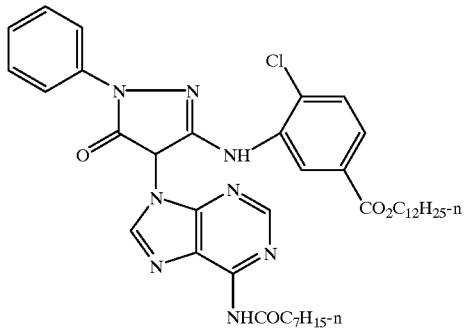
A6
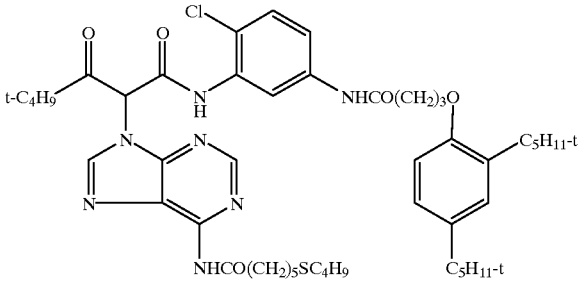
A7
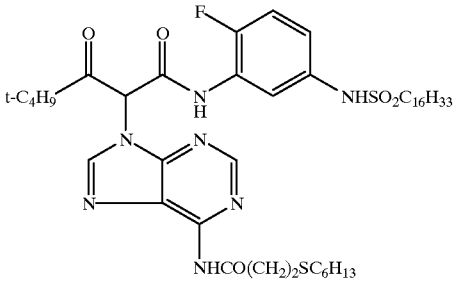
A8
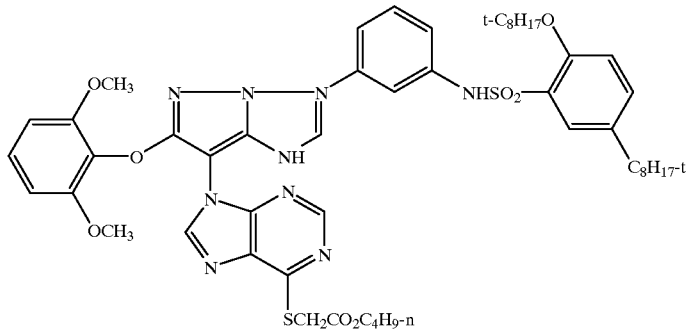
A9
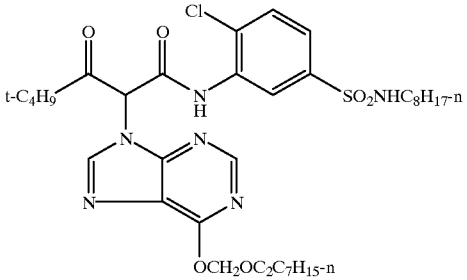

-continued
A10
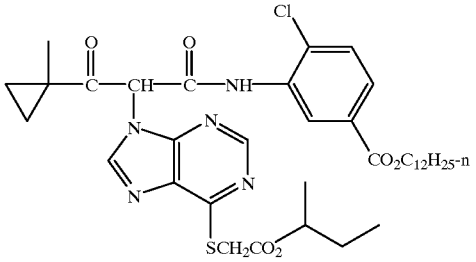
A11
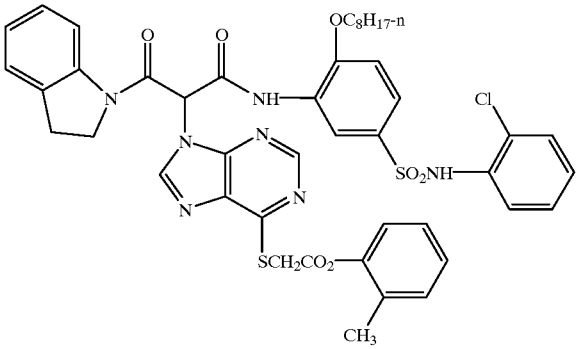
A12
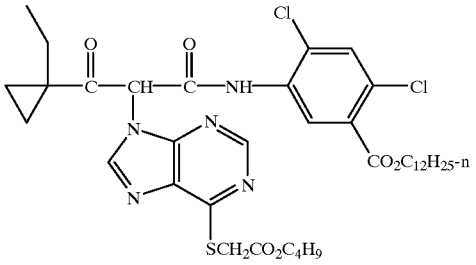
A13
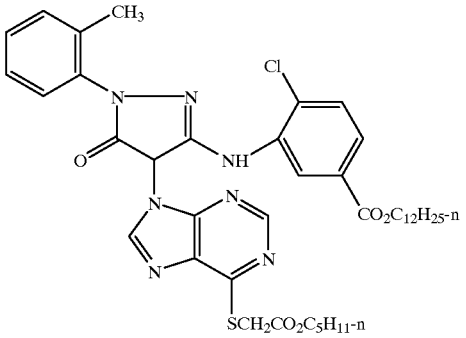
A14
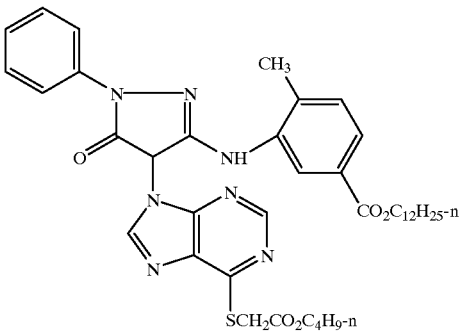

-continued
A15
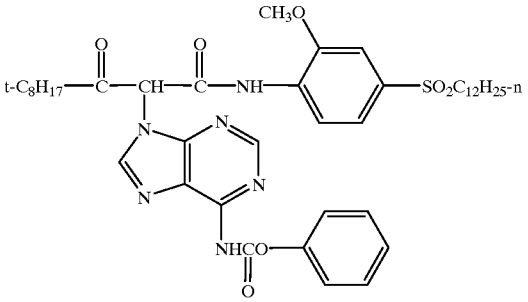
A16
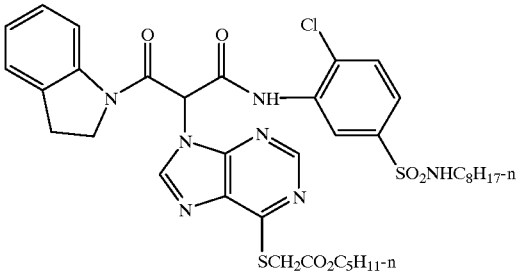
A17
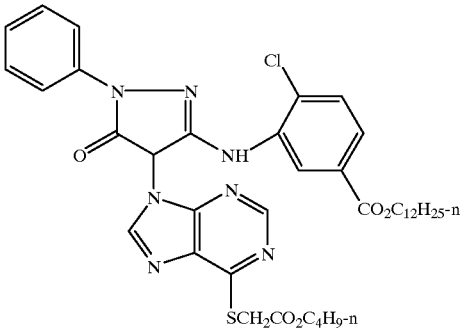
A18
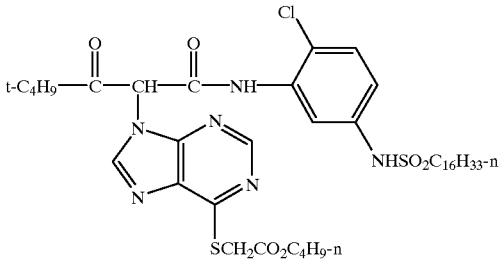
A19
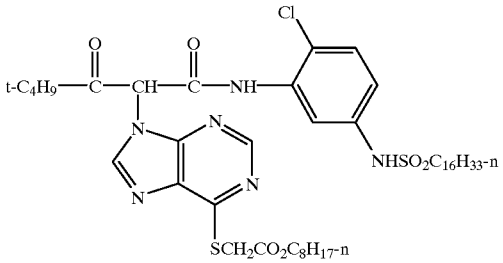

-continued
A20
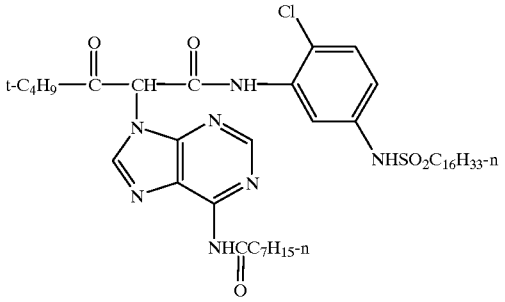
A21
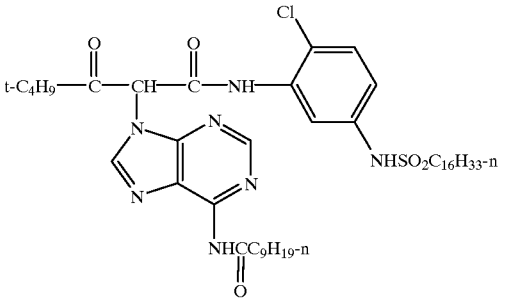
A22
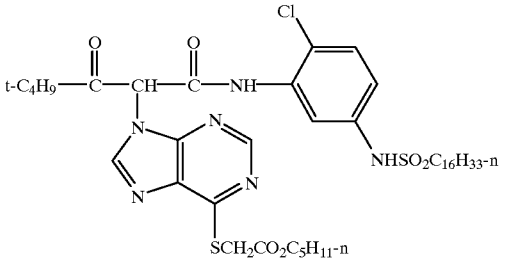
A23
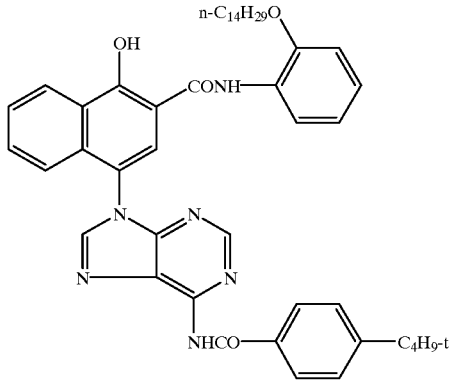
A24
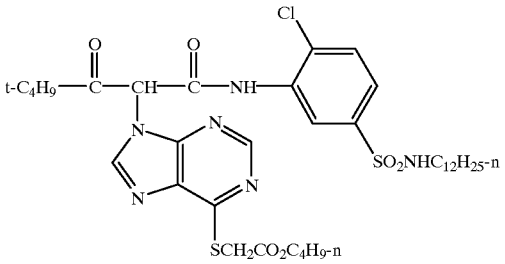

-continued

A25

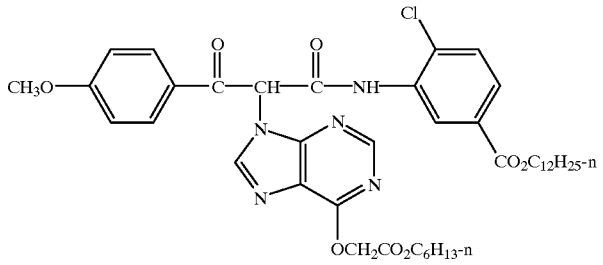

A26

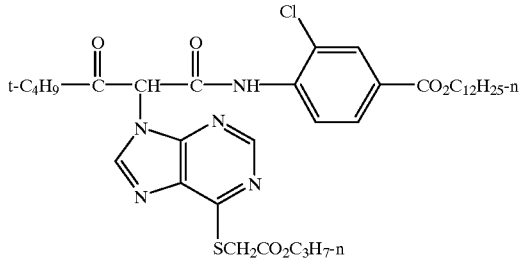

Useful coated levels of the DIR couplers of this invention range from about 0.005 to 0.50 g/sq m, or more typically from 0.01 to 0.30 g/sq m.

The couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexene may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate, tripentyl citrate or dibutyl sebecate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p 993. Useful coupler:coupler solvent weight ratios range from about 1:0.1 to 1:8.0, with 1:0.2 to 1:4.0 being preferred.

The DIR couplers of this invention can be used in color photographic elements. Such elements typically contain at least one silver halide emulsion sensitive to blue light, at least one silver halide emulsion sensitive to green light and at least one silver halide emulsion sensitive to red light. The DIR couplers of this invention can advantageously be included in any of the silver halide emulsions and are particularly advantageous when coated with thin tabular grain silver halide emulsions.

Use of the DIR couplers of this invention in color negative films comprising magnetic recording layers is also specifically contemplated. The efficient DIR couplers of this invention may allow reductions in the levels of masking couplers in such films, thereby lowering minimum densities, which may otherwise be undesirably high.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,41 1; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 mm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure,* Item 38957, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexaco-ordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photogaphic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The following examples illustrate the synthesis and use of DIR couplers in accordance with the invention.

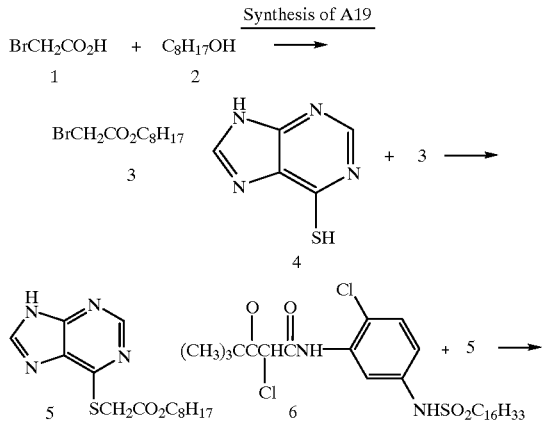

-continued

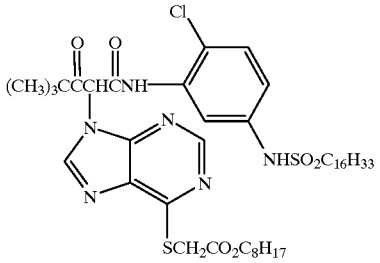

A19

Synthesis of 3

A solution of bromoacetic acid (67 grams, 0.48 moles) 1 and octyl alcohol (77 mLs, 0.48 moles) 2 in 600 mLs of dichloromethane was treated first with a catalytic amount of N,N-dimethylaminopryidine (DMAP) and then dropwise with dicyclohexylcarbodiimide (DCC, 100 grams, 0.48 moles) in 200 mLs of dichloromethane. The reaction was stirred for 30 minutes. The resulting solid was filtered and discarded. The dichloromethane was removed under vacuum. The resulting oil 3 was then used without further purification in the synthesis of 5.

Synthesis of 5

A slurry of 6-mercaptopurine (10 grams, 0.06 moles) 4 in a solution of 400 mLs of methanol and 13 grams of sodium methoxide (0.06 moles) was treated in one portion with 5 (15.5 grams, 0.06 moles) in 100 mLs of methanol. Within a few minutes all solids were in solution. The solution was stirred at room temperature for 2 hours and poured into 1200 mLs of cold water. The solid that formed was filtered and air dried to give 17.5 grams as a white solid (92%). The structure was confirmed by NMR spectroscopy.

Synthesis of A19

A solution of 5 (3.8 grams, 0.012 moles) and 6 (7 grams, 0.012 moles) in dimethylformamide was treated in one portion with tetramethylguandine (4.5 mLs, 0.036 moles). The reaction was stirred at room temperature for 3 hours. The reaction was poured into a stirred solution of cold dilute HCl. This was extracted with ethyl acetate. The organic layer was dried with magnesium sulfate, and the solvent was removed under vacuum. The oil obtained was purified by column chromatography, eluting with 60% ligroin/40% ethyl acetate. This gave the desired product as an oil with one spot on TLC (ethyl acetate 25%, heptane 75%). The structure was confirmed by NMR spectroscopy and Mass Spectroscopy.

EXAMPLE 1

Illustration of Superior Gamma Reduction Provided by DIR Couplers of this Invention It is desirable that DIR couplers efficiently reduce photographic gamma or contrast to provide benefits such as enhanced sharpness, reduced granularity and improved exposure latitude. To illustrate the superior efficiencies of the DIR couplers of this invention in reducing gamma they were compared to DIR couplers used in commercial photographic films in a simple photographic format shown below in Table IA. Structures of the yellow dye-forming imaging coupler Y-1 used in these films and of the comparative DIR couplers C1 and C2 are given immediately after Table 1 A. All of the DIR couplers used in this comparison are yellow dye-forming couplers and all are coated at levels of 0.0646 (a) and 0.1292 (b) millimoles/sq m. The yellow imaging coupler Y-1 was coated alone to provide a check position uninhibited gamma and with the DIR couplers to provide a read out of silver development inhibition. Coated levels in g/sq m are given in parentheses in Table IA.

All DIR couplers were dispersed at a 1:1 weight ratio in dibutyl phthalate (S-2). The dispersions were prepared by adding an oil phase containing a 1:1:3 weight ratio of DIR coupler: S-2:ethyl acetate to an aqueous phase containing gelatin and the dispersing agent ALKANOL XC (DuPont) in a 10:1 weight ratio. The mixture was then passed through a colloid mill to disperse the oil phase in the aqueous phase as small particles. On coating, the ethyl acetate auxiliary solvent evaporates. Coupler Y-1 was dispersed at a 1:0.5 weight ratio with tritolyl phosphate (S-1, mixed isomers)

TABLE IA

| | |
|---|---|
| OVERCOAT LAYER: | |
| Gelatin (5.38) & Bis(vinylsulfonylmethyl)ether Hardener (0.259) | |
| PHOTOGRAPHIC LAYER: | |
| Y-1 (0.861) & S-1 (0.430) | |
| Green-Sensitive 0.46 μm Silver Iodobromide Emulsion (0.807 Ag) Gelatin (2.69) | |
| and A) No DIR Coupler (Uninhibited Check) | |
| or B) C1 Comparison (0.063) | level a & S-2 (0.063) |
| or C) C1 Comparison (0.127)) | level b & S-2 (0.127) |
| or D) C2 Comparison (0.049) | level a & S-2 (0.049) |
| or E) C2 Comparison (0.098) | level b & S-2 (0.098) |
| or F) A19 Invention (0.057) | level a & S-2 (0.057) |
| or G) A19 Invention (0.113) | level b & S-2 (0.113) |
| or H) A20 Invention (0.053) | level a & S-2 (0.053) |
| or I) A20 Invention (0.105) | level b & S-2 (0.105) |
| or J) A21 Invention (0.055) | level a & S-2 (0.055) |
| or K) A21 Invention (0.109) | level b & S-2 (0.109) |
| or L) A22 Invention (0.054) | level a & S-2 (0.054) |
| or M) A22 Invention (0.108) | level b & S-2 (0.108) |
| Cellulose Acetate Support with Gel U-Coat and Removable Carbon Antihalation Backing | |

Y-1

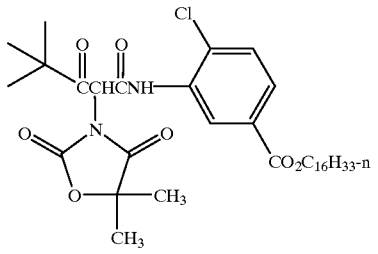

C1

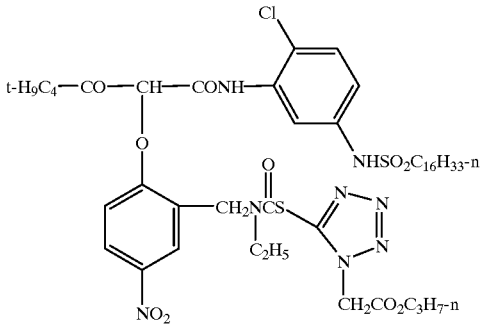

TABLE IA-continued

C2

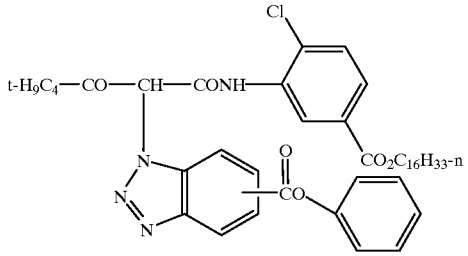

Film samples were given a sensitometric white light (neutral) exposure and processed using a KODAK FLEXICOLOR C-41 process with a 1% sulfuric acid solution stop bath inserted between the development and bleach steps. The processing steps are given in Table IB. Status M blue densities produced by the yellow dyes formed from Y-1 and the DIR couplers were then measured and plotted vs exposure. The slopes of the straight line portions of these plots yield values for blue gamma. The gamma values for the uninhibited check film with only Y-1 and for the films containing DIR coupler at levels a and b are given Table IC. It is clear from the data in Table IC that the DIR couplers of this invention provide larger reductions in gamma than the comparison couplers at the same molar laydowns. This is a desirable feature for many photographic applications. In some cases, such as with coupler A19, the DIR couplers of this invention yield surprisingly large efficiency advantages in reducing gamma.

TABLE IB

C-41 Processing Solutions and Conditions

| Solution | Process Time | Agitation Gas |
|---|---|---|
| C-41 Developer | 3 min. 15 sec. | Nitrogen |
| Stop Bath | 30 sec. | Nitrogen |
| Wash | 2 min. 00 sec. | None |
| Bleach | 3 min. 00 sec. | Air |
| Wash | 3 min. 00 sec. | None |
| Fix | 4 min. 00 sec. | Nitrogen |
| Wash | 3 min. 00 sec. | None |
| Wetting Agent Bath | 30 sec. | None |

Process temperature 100° F. (38° C.).

TABLE IC

| Coating | DIAR Coupler | Level | Blue Gamma |
|---|---|---|---|
| A | None Check | — | 1.750 |
| B | C1 Comparison | a | 1.393 |
| C | C1 Comparison | b | 0.930 |
| D | C2 Comparison | a | 1.337 |
| E | C2 Comparison | b | 1.170 |
| F | A19 Invention | a | 0.660 |
| G | A19 Invention | b | 0.460 |
| H | A20 Invention | a | 1.108 |
| I | A20 Invention | b | 0.895 |
| J | A21 Invention | a | 1.102 |
| K | A21 Invention | b | 0.865 |
| L | A22 Invention | a | 0.810 |
| M | A22 Invention | b | 0.598 |

EXAMPLE 2

Use of the DIR Couplers of This Invention With a T-Grain Silver Chloride Emulsion Several DIR couplers of this invention were coated together with a T-grain silver chloride emulsion and the yellow dye-forming image coupler Y-1 in the format shown in Table IIA. DIR coupler laydowns X, Y, and Z were respectively 1.2%, 6% and 12% of the Y-1 laydown on a molar basis. This corresponds, for example, to 0.017, 0.085 and 0.170 g/sq. m of A3 for X, Y, and Z, respectively. Films were exposed and processed with the modified C-41 process shown in Table IIB, wherein the development time is reduced to 90 sec. While it is normally difficult to produce gamma reductions with DIR couplers for rapidly-developing, silver chloride emulsions, the DIR couplers of this invention generally produced significant reductions in gamma and fairly smooth density vs exposure curves.

TABLE IIA

OVERCOAT LAYER:
Gelatin (1.00)
PHOTOGRAPHIC LAYER:

Y-1 (1.17) & S-2 (0.585)
Silver Chloride (0.3% I) T-Grain (1.0 × 0.1 μm) Emulsion (0.55 Ag)
Gelatin (2.42)
Bis(vinylsufonyl)methane hardener (0.060)
and A) No DIR Coupler (Uninhibited Check)
or B) DIR A3 (X, Y & Z) & S-2 at equal weight to A3
or C) DIR A6 (X, Y & Z) & S-2 at equal weight to A6
or D) DIR A20 (X, Y & Z) & S-2 at equal weight to A20
Cellulose Acetate Support with Gel U-Coat
and Removable Carbon Antihalation Backing

TABLE IIB

C-41 Processing Solutions and Conditions

| Solution | Process Time |
|---|---|
| C-41 Developer | 1 min. 30 sec. |
| Stop Bath | 1 min. 00 sec. |
| Wash | 2 min. 00 sec. |
| Bleach | 4 min. 00 sec. |
| Wash | 2 min. 00 sec. |
| Fix | 4 min. 00 sec. |
| Wash | 2 min. 00 sec. |

Process temperature 100° F. (38 ° C.).

The invention has been described in detail with particular reference to preferred embodiments, but it will be understood that variations and modifications can be effected within the spirit and scope of the invention.

What is claimed is:

1. A photographic element comprising a support bearing at least one silver halide emulsion and at least one DIR coupler of structure I:

I

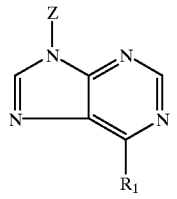

wherein:

Z is a moiety which can react with oxidized developer to release a coupling-off group;

$R_1$ is selected from the substituents shown in formulas II, III, IV and V:

II —$SCH_2CO_2R_2$, III —$NHCOR_3$, IV —$OCH_2CO_2R_4$, V —$OR_5$;

$R_2$ is an alkyl group with at least 3 carbon atoms or an aryl group with at least 7 carbon atoms;

$R_3$ is an alkyl or alkoxy group with at least 4 carbon atoms or an aryl or phenoxy group with at least 7 carbon atoms; and $R_4$ and $R_5$ are alkyl groups with at least 4 carbon atoms or aryl groups.

2. A photographic element according to claim 1, wherein Z is selected from beta-dicarbonyl compounds, indanones, 1-phenyl-3-anilino-5-pyrazolones, pyrazoloazoles, phenols, and naphthols.

3. A photographic element according to claim 2, wherein Z is a beta-dicarbonyl compound selected from acylacetanilides, beta-ketoketones and beta-ketoesters.

4. A photographic element according to claim 1, wherein the DIR coupler of structure I is coated in the same layer with at least one tabular-grain silver halide emulsion.

5. A photographic element according to claim 1, wherein the DIR coupler is coated in the same layer with at least one silver chloride emulsion.

6. A photographic element according to claim 1, wherein the DIR coupler is present in the photographic element at a level of 0.005 to 0.50 g/sq. m.

7. A photographic element according to claim 1, wherein $R_1$ is an —$SCH_2CO_2R_2$ group and wherein $R_2$ is an alkyl group having 3 to 9 carbon atoms or a phenyl group with 7 to 12 carbon atoms.

8. A photographic element according to claim 1, wherein $R_1$ is an —$NHCOR_3$ group and wherein $R_3$ is an alkyl or alkoxy group with 6 to 11 carbon atoms or a phenyl or phenoxy group with 9 to 14 carbon atoms.

9. A photographic element according to claim 1, wherein $R_1$ is an —$OCH_2CO_2R_4$ group and wherein $R_4$ is an alkyl group with 4 to 10 carbon atoms or a phenyl group with 7 to 13 carbon atoms.

10. A photographic element according to claim 1, wherein $R_1$ is an —$OR_5$ group and wherein $R_5$ is an alkyl group with 4 to 10 carbon atoms or a phenyl group with 7 to 13 carbon atoms.

11. A photographic element according to claim 1, wherein the DIR coupler of structure I is of structure VI, below:

VI

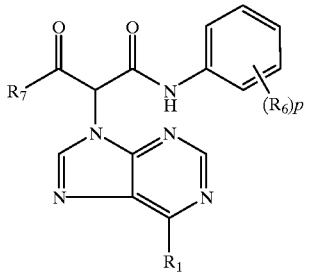

wherein:

$R_1$ is as defined in claim 1;

each of the $R_6$ substituents is individually selected from the group consisting of halogen atoms and alkyl, aryl, alkoxy, phenoxy, alkylthio, carbonamido, alkoxycarbonyl, aryloxycarbonyl, acyloxy, sulfamoyl, carbamoyl, alkylsulfonyl, arylsulfonyl, sulfonamido, sulfonyloxy, sulfoxyl and cyano groups;

$R_7$ is a substituent selected from the group consisting of tertiary alkyl, cyclic tertiary alkyl, aryl, heterocycle, arylamino and alkylamino groups; and p is 0 to 4.

12. A photographic element according to claim 11, wherein the DIR coupler of structure VI is of structure VII:

VII

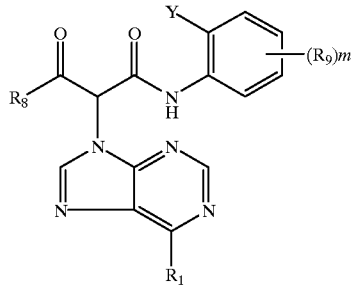

wherein:

$R_1$ is as defined in claim 1;

$R_8$ is a tertiary alkyl group;

Y is a halogen atom or an alkyl or alkoxy group;

each $R_9$ substituent is in the 4- or 5-position relative to the anilino nitrogen atom and is a halogen atom or a substituent selected from the group consisting of alkyl, aryl, alkoxycarbonyl, aryloxycarbonyl, sulfonamido, sulfamoyl, acyloxy, alkylsulfonyl, arylsulfonyl, sulfoxyl, sulfonyloxy and cyano groups; and m is 0, 1 or 2.

13. A photographic element according to claim 1, wherein the DIR coupler of structure I is of formula VIII:

VIII

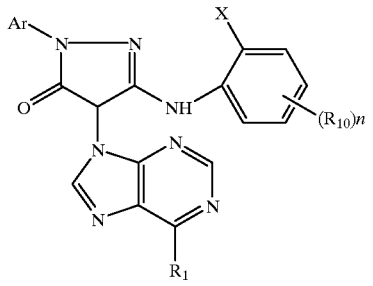

wherein:

$R_1$ is as defined in claim 1;

Ar is an unsubstituted aryl group or an aryl group with one or more substituents individually selected from the group consisting of halogen atoms and alkyl, aryl, alkoxy, phenoxy, carbonamido, carbamoyl, sulfonamido, sulfamoyl, alkoxycarbonyl, aryloxycarbonyl, acyloxy, alkylsulfonl, arylsulfonyl, sulfonyloxy, sulfoxyl, alkylthio and cyano groups;

X is a halogen atom or an alkyl or alkoxy group;

n is 0, 1 or 2; and each $R_{10}$ is in the para position or either meta position relative to the NH group and is individually selected from the group consisting of halogen atoms, and alkyl, aryl, alkoxy, phenoxy, carbonamido, carbamoyl, sulfonamido, sulfamoyl, alkoxycarbonyl, aryloxycarbonyl, acyloxy, alkylsulfonyl, arylsulfonyl, sulfonloxy, sulfoxyl, alkylthio, cyano and imido groups.

14. A photographic element according to claim 13, wherein Ar is an aryl group with at least one position ortho to the point of attachment to the parazolone ring unsubstituted.

15. A photographic element according to claim 12, wherein DIR coupler VII is coated in the same layer with al least one blue-sensitive silver halide emulsion.

16. A photographic element according to claim 13, wherein DIR coupler VIII is coated in the same layer with at least one green-sensitive silver halide emulsion.

17. A photographic element according to claim 12, wherein Y is a chlorine atom, R7 is a t-butyl group and m is 1.

18. A photographic element according to claim 1, wherein $R_1$ is a —$SCH_2CO_2R_2$ group and wherein $R_2$ is an alkyl group with 3 to 8 carbon atoms.

19. A photographic element according to claim 1 further comprising a magnetic recording layer.

20. A photographic element according to claim 1, wherein the DIR coupler is selected from the group consisting of:

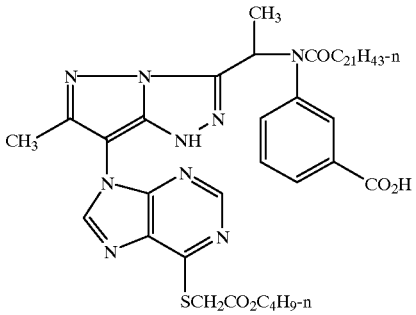

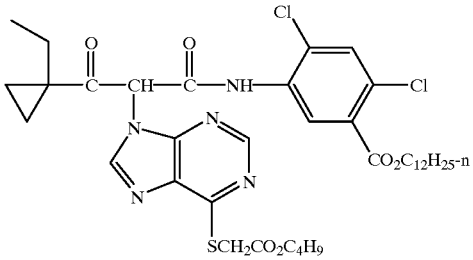

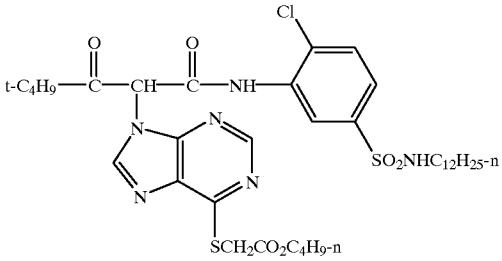

-continued

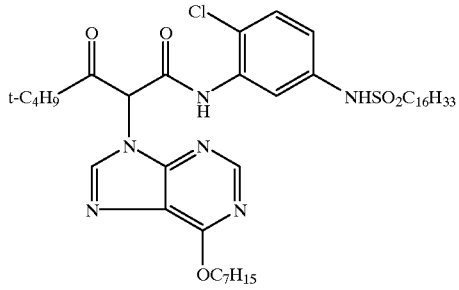

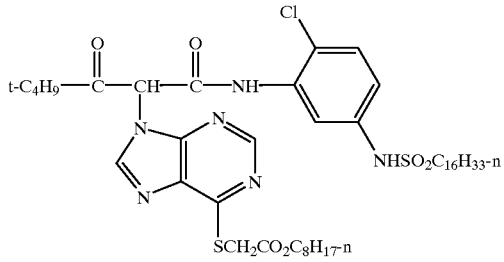

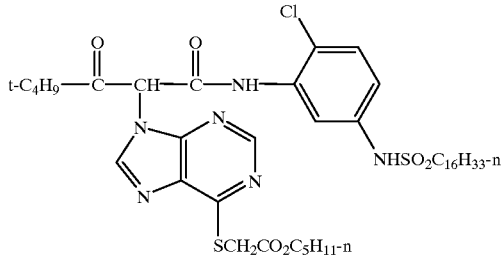

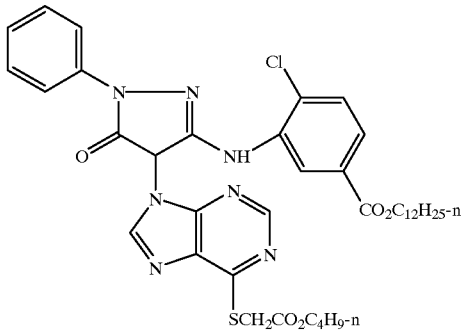

and

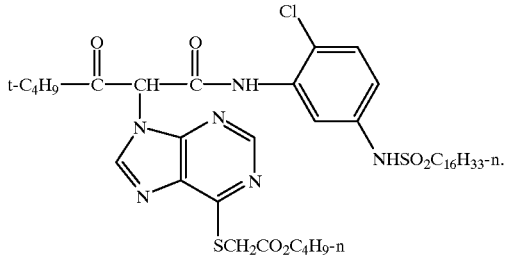

* * * * *